United States Patent [19]

Richter et al.

[11] Patent Number: 4,637,878

[45] Date of Patent: Jan. 20, 1987

[54] RECIPROCAL MOVABLE SCREENS IN A VERTICALLY ELONGATED VESSEL

[75] Inventors: Johan C. F. C. Richter, Oslo, Norway; Ole J. Richter, Karlstad, Sweden

[73] Assignee: Kamyr Aktiebolag, Karlstad, Sweden

[21] Appl. No.: 356,464

[22] Filed: Mar. 9, 1982

[51] Int. Cl.[4] ..... B01D 33/00

[52] U.S. Cl. ..... 210/388; 162/251

[58] Field of Search ..... 162/251; 210/384, 388, 210/456

[56] References Cited

U.S. PATENT DOCUMENTS

| | | | |
|---|---|---|---|
| 2,163,437 | 6/1939 | Richmond | 162/251 |
| 2,667,975 | 2/1954 | Seaholm | 210/388 |
| 2,695,232 | 11/1954 | Richter | 210/340 X |
| 2,964,193 | 12/1960 | Heckmann | 210/388 X |
| 3,579,420 | 4/1968 | Richter | 210/388 X |
| 3,711,367 | 1/1973 | Christenson | 210/340 X |
| 3,752,319 | 8/1973 | Richter | 210/357 |

FOREIGN PATENT DOCUMENTS

| | | |
|---|---|---|
| 836840 | 3/1970 | Canada . |
| 949460 | 6/1974 | Canada . |

*Primary Examiner*—David Sadowski

*Attorney, Agent, or Firm*—Nixon & Vanderhye

[57] ABSTRACT

In vertical vessels, particularly continuous pulp digesters, fibrous material suspended in liquid passes downwardly past screens through which treatment liquid is withdrawn. The screens are reciprocated vertically up and down utilizing a piston and cylinder assembly, operatively connected by a two-way valve to a source of fluid under pressure or a vent. The piston and screen are connected by a universal joint, and the screen is positively guided during movement. The piston is vertically above the screen and the screen moves downwardly under pressure from the pump, and returns upwardly, under the influence of interior digester pressure, during normal digester operation.

20 Claims, 8 Drawing Figures

11
12
21
21
42
42
42
10
10
10
13
V
V
V
P
44
43
TIMER 81
71
30''
72
25''
64
65
21''

RECIPROCAL MOVABLE SCREENS IN A VERTICALLY ELONGATED VESSEL

BACKGROUND AND SUMMARY OF THE INVENTION

In many situations where fluid, particularly liquid, is screened from a suspension, problems of screen clogging are common. Especially if some of the particles in the material being screened are fine, they have a tendency to clog up the screen slots or openings, resulting in greatly reduced efficiency or stoppage of the screening process.

Problems with screen clogging are especially prevalent in vertical vessels for passing fibrous material suspended in liquid, particularly pulp digesters, such as continuous digesters. Normally the pulp moves downwardly in the vessel under the influence of gravity, and must overcome the wall friction which increases substantially at the screens. Also, slight counter-current flows are provided in parts of the vessel, and there can be a tendency to floatation of the material particles due to the presence of gases. All of these problems, especially the wall friction problem, compound when there is a high content of fines in the pulp material. The result is that the force of gravity may not be sufficient to overcome all of the countervailing forces, and the column of material can stop moving. This is called "hang-up", or "hanging".

Once the material column stops moving, the screens will clog up solidly, and the entire vessel must be shut down until the problem is corrected. Alternatively, there have been numerous installations in the past that have utilized a variety of flow control mechanisms to try to prevent screen clogging, typical conventional flow mechanisms being illustrated in U.S. Pat. Nos. 2,695,232 and 3,711,367. Also, there has been provided a specialized screen having some stationary and some movable parts, the movable parts being pivotal about a generally horizontal axis in response to a horizontal force applied by a cylinder or the like, such as shown in U.S. Pat. No. 3,752,319.

While many prior art proposals can be reasonably effective in preventing hanging, hanging problems still occur in many situations. The present invention deals with the hanging problem, and provides a relatively simple apparatus and method that are utilizable in a wide variety of vessels and environments. The invention is really adaptable to retrofitting to existing installations, and finds particular applicability in both continuous and batch pulp digesting vessels.

The structure according to the present invention is provided in a vertical vessel for vertically passing fibrous material suspended in liquid, the vessel having a vertical wall curved about a vertical axis. The structure includes a vertically elongated screening member, curved about a vertical axis. Preferably a plurality of such members are mounted in the vessel around the interior perimeter thereof, and normally provide for the withdrawal of treatment fluid at various stages of the material processing. Means are provided for mounting the screening members inside and adjacent the vertical wall of the vessel for up and down reciprocal movement, defining a screening volume between the screening member and the vertical wall, and for substantially sealing the volume between the screening member and the vertical wall from the interior of the vessel, except through the screening member and slots of about 2–5 mm clearance between the screen elements and the walls of the vessel, during reciprocation of the screening member. Means are provided for reciprocating the screening member vertically up and down with respect to the vertical wall.

The reciprocating means preferably comprise a single piston and cylinder assembly mounted above each screening member, with the underside of the piston connected to the digester pressure. Means are provided for operatively attaching the piston to the screening member, such as universal joint means, and a fluid conduit is operatively connected to the top of the cylinder and a two-way valve. Means are provided for selectively operatively connecting the valve to a source of fluid under pressure, such as a high pressure liquid pump, or to a vent, such as a flash tank. A hollow component having a plate-like body with a curvature corresponding to the curvature of the screening member may be provided to enclose the reciprocating means and adapt the structure according to the invention to a wide variety of vessels. The body of the hollow component is spaced from the vessel vertical wall at a first end of the body, the first end overlapping the screening member and disposed interiorly thereof, and the body tapers to the vessel wall at a second end thereof opposite the first end. The entire screen assembly may be provided as an insert.

In practicing a method according to the invention, fibrous material, such as paper pulp, is passed vertically downwardly in a vessel, past screens disposed around the vessel periphery. The screens are reciprocated in the same direction of movement as the pulp, proper cleaning of the screens resulting. The screens are not moved positively by an actuator in both directions. Rather the screens are only moved downwardly by an actuator, but are allowed to move upwardly themselves under digester pressure.

It is the primary object of the present invention to provide a simple and effective structure for keeping screens in digesters, or the like, from clogging. This and other objects of the invention will become clear from an inspection of the detailed description of the invention, and from the appended claims.

DETAILED DESCRIPTION OF THE DRAWINGS

Figure 1:
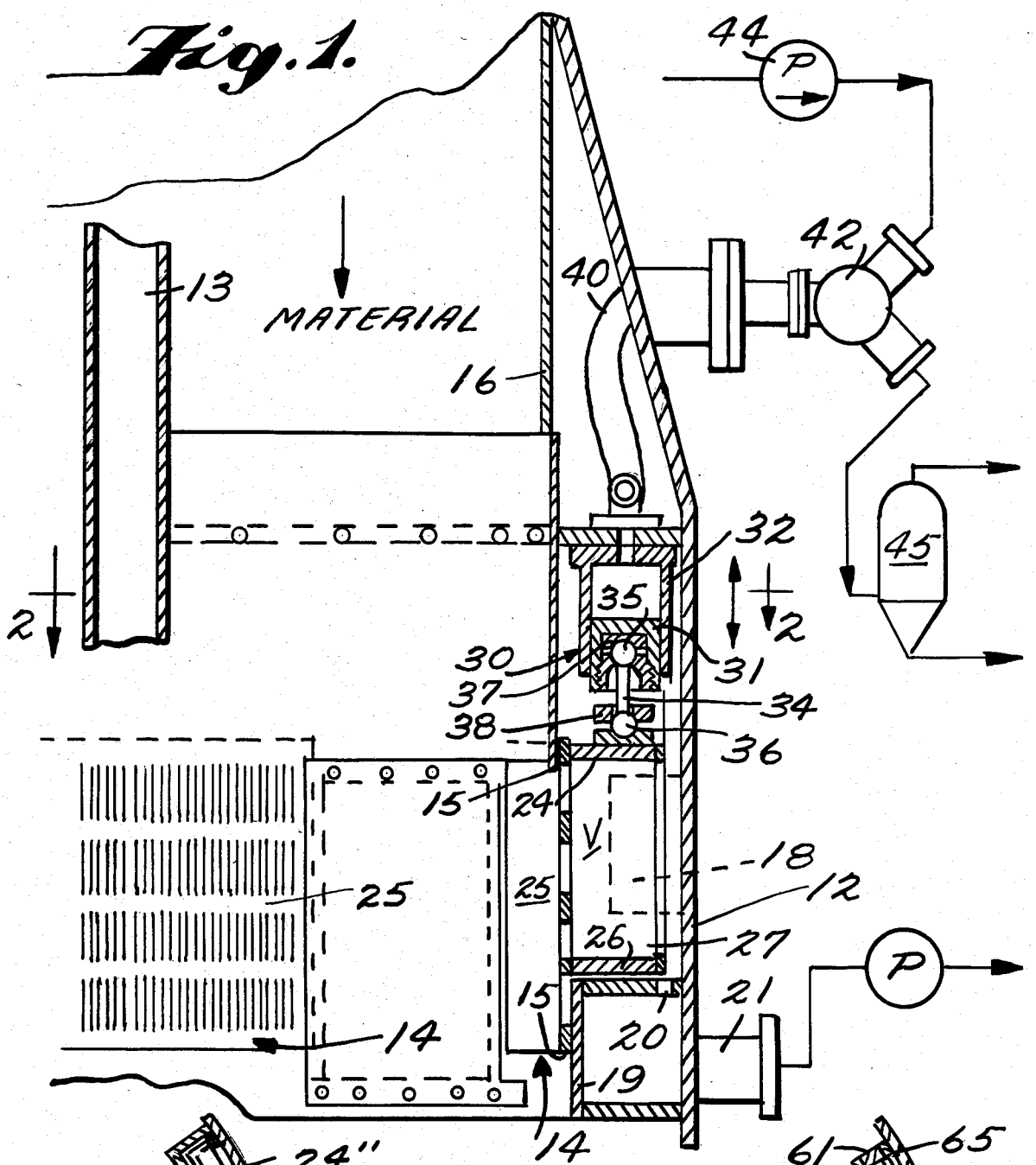
FIG. 1 is a vertical cross-sectional view of a portion of an exemplary pulp digester illustrating the screens, and associated reciprocating structures, according to the invention.
Figure 5:
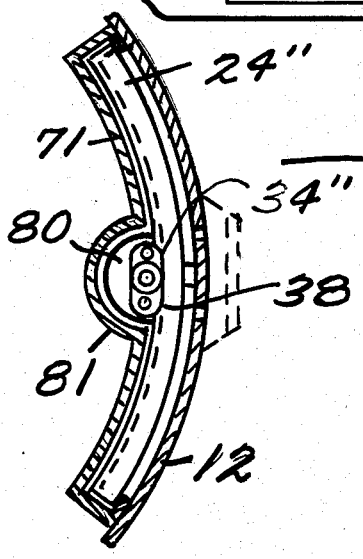
FIGS. 5 and 6 are horizontal cross-sectional views of the specific components of the structure of FIG. 4 taken along lines 5—5 and 6—6, respectively, thereof.
Figure 2:
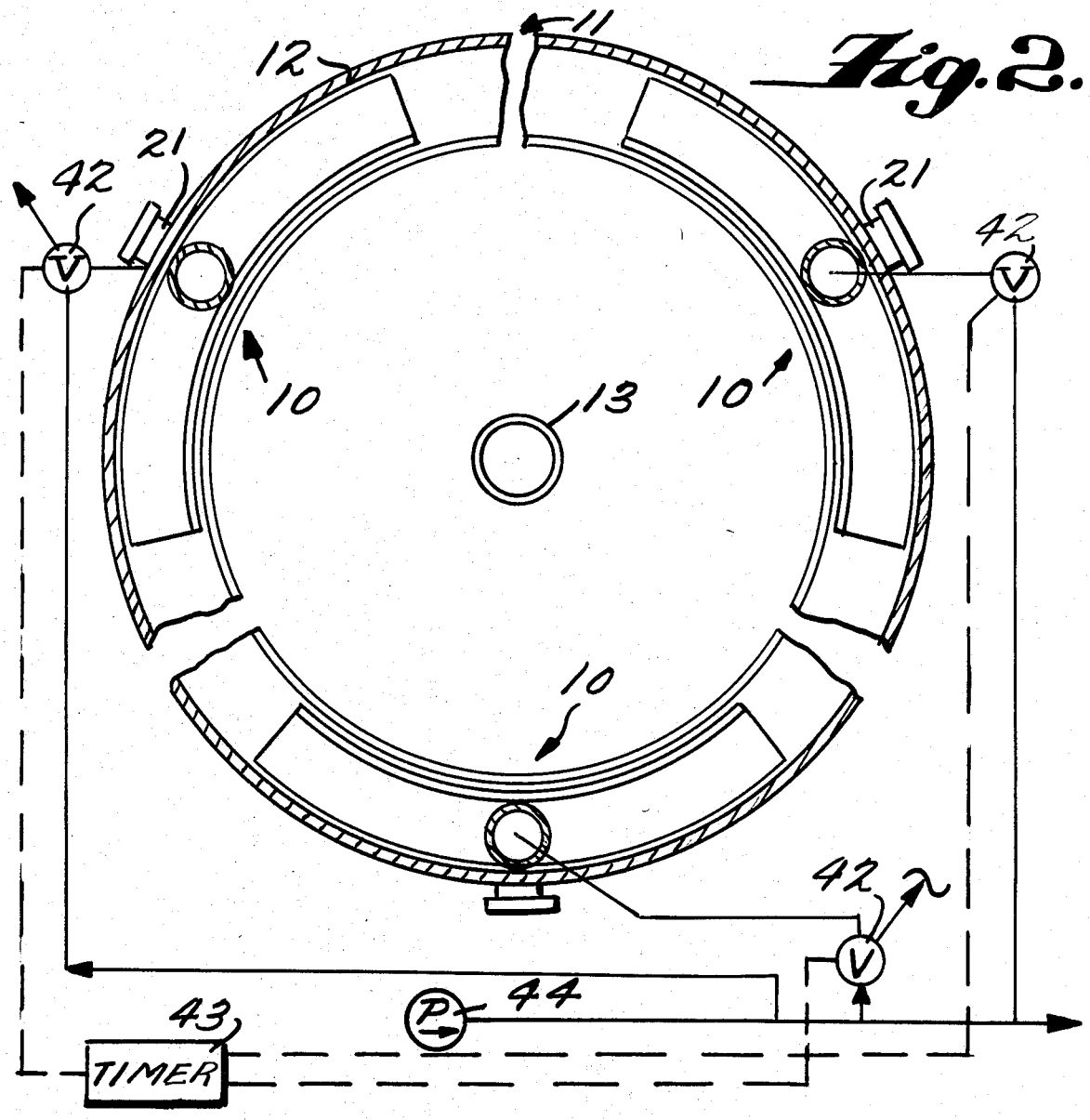
FIG. 2 is a horizontal cross-sectional view of the vessel of FIG. 1 taken along lines 2—2, and schematically showing typical components associated therewith.
Figure 8:
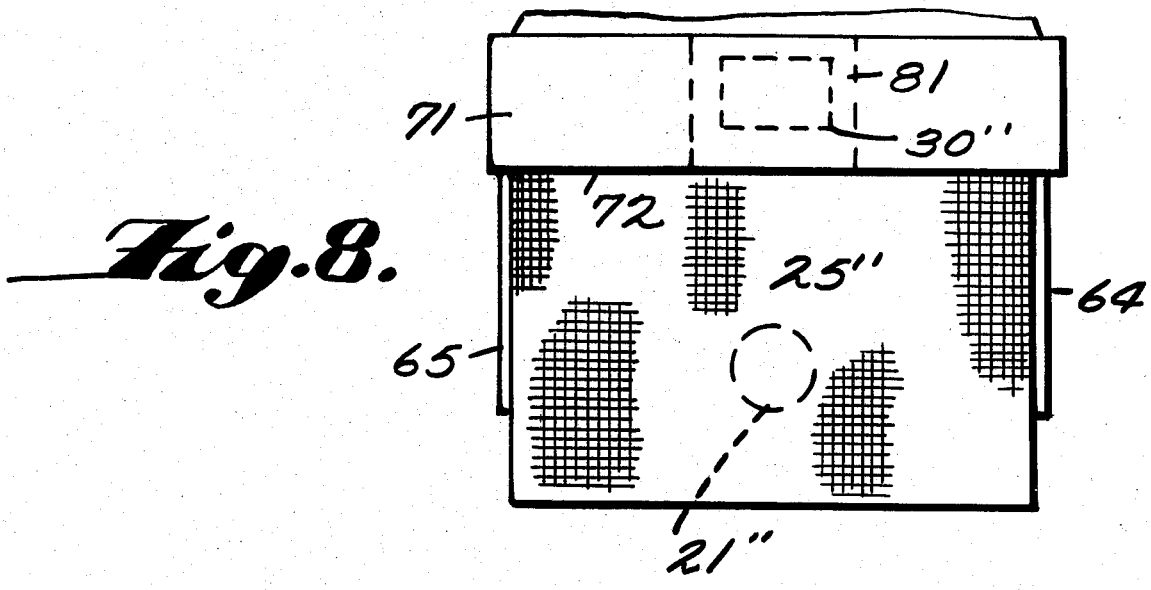
FIG. 8 is an end view, in the direction of the arrow X in FIG. 4, of an exemplary structure according to the invention.
Figure 3:
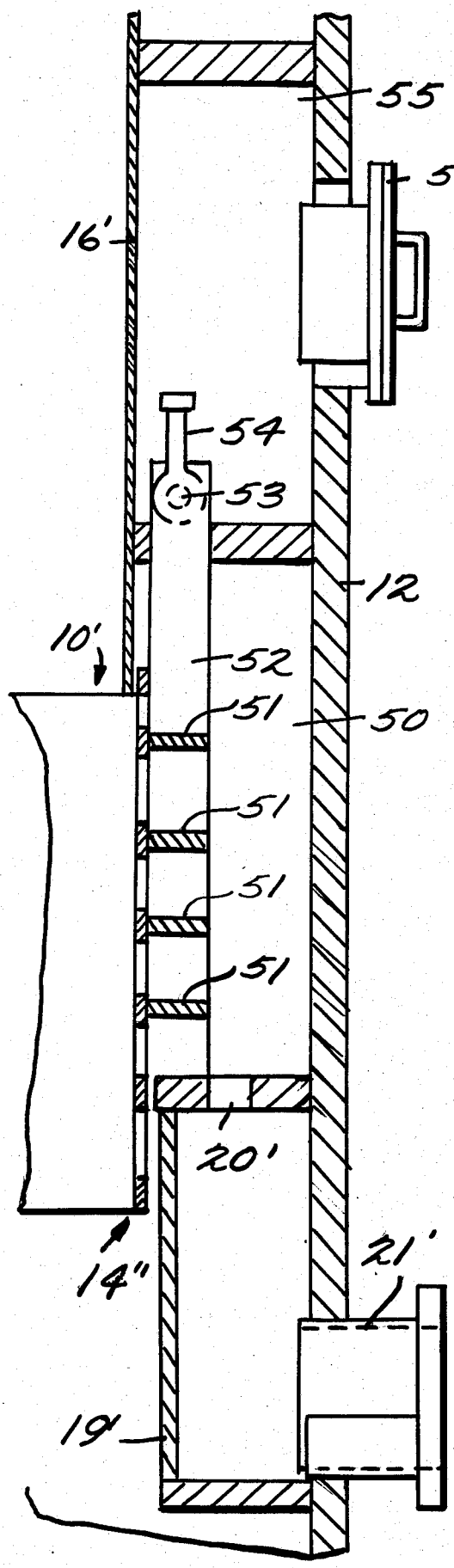
FIG. 3 is a vertical detail cross-sectional view like that of FIG. 1 only showing a modified form of the structure according to the invention.
Figure 4:
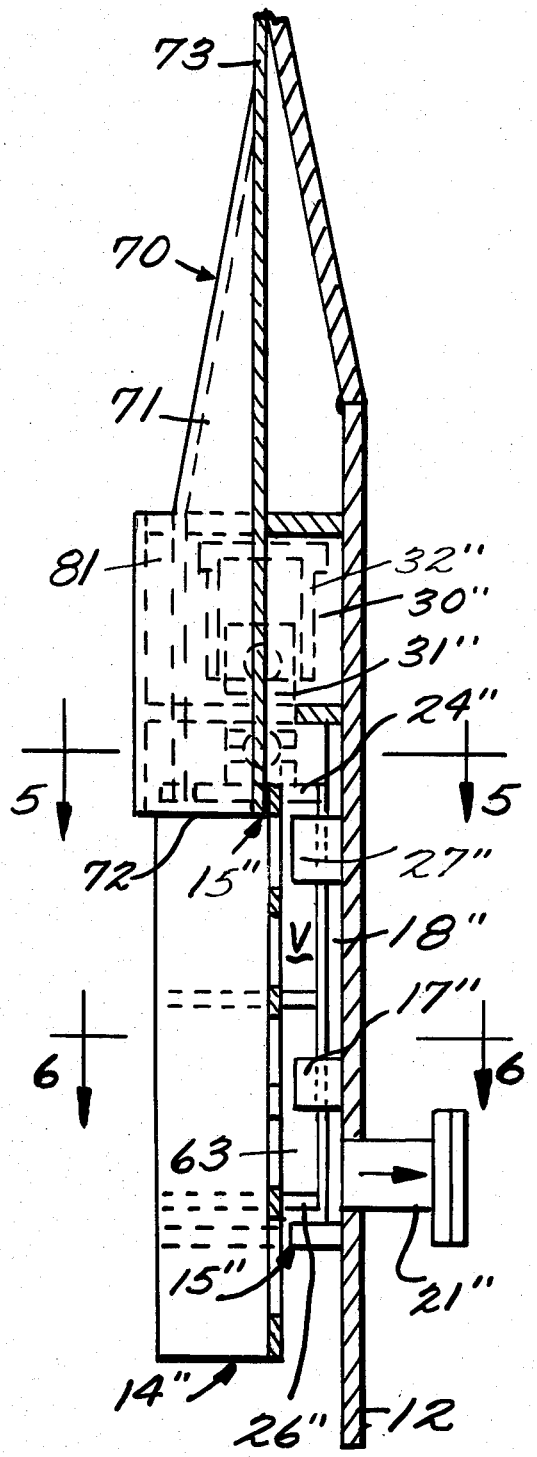
FIG. 4 is another view like that of FIG. 1 only showing yet another modification of the structure according to the invention.

A structure according to the present invention is shown generally by reference numeral 10 in FIGS. 1 and 2, numeral 10' in FIG. 3, and numeral 10" in FIGS. 4 through 7. In each case the structure is associated with a vessel 11 for vertically passing fibrous materials suspended in liquid, typically a continuous or batch pulp digester. The vessel has a vertical wall 12 curved about a vertical axis (e.g. circular in diameter). A central liquid distribution pipe conventionally is provided for introducing treatment liquid into the material column, which liquid subsequently is removed through screening structures 14. A plurality of structures 10, 10', 10" according to the present invention are mounted in the vessel 11 around the interior perimeter thereof, as seen in FIG. 2.

Each structure 10 according to the present invention comprises a vertically elongated screening member 14, curved about a vertical axis, and having a curvature fitting the vessel wall 12. Means are provided for mounting the screening member 14 inside and adjacent the vertical wall 12 for up and down reciprocal movement, defining a screening volume V between the screening member 14 and the vertical wall 12. Also substantial sealing of the volume V from the interior of the vessel 11 is provided, except through the screening member 14 and small (e.g. 2–5 mm) gaps 15 providing clearance and acting as part of the screen area. Such mounting means, as illustrated in FIG. 1, includes the inner walls 16 above the screening member 14, vertical ribs 17 in the volume V affixed to the wall 12 and affixed to with vertically extending guide plate 18, and a quadrate cross-section header 19 mounted below the screening member 14. A plurality vertically extending passageways 20 are provided in the header 19 distributed regularly over the width of the screen to allow liquid flow from the volume V out through the vessel wall 12 through conduit 21.

For the particular structure configuration 10 illustrated in FIGS. 1 and 2, an upper horizontally disposed bar 24 is affixed to the actual screen face 25, which face 25 may be slotted (see FIG. 1), may be formed by staves, or may have other types of openings formed therein. At least one other horizontal bar 26, like the bar 24, is provided parallel to, but spaced from, the bar 24. A pair of vertically extending plates 27 interconnecting the bars 24, 26 receive the guide plate 18 therebetween.

Means are also provided for reciprocating the screening member 14 vertically up and down with respect to the wall 12. The reciprocating means preferably comprises a piston and cylinder assembly 30, including piston 31 and cylinder 32. Preferably only a single cylinder 30 is provided for each screening member 14, and is mounted above the screening member 14, within the volume defined by the false wall 16. Means are provided for operatively attaching the piston 31 to the screening member 14. Preferably such means takes the form of universal joint means, such as (see FIG. 1) a rod 34 having a ball-shaped head 35, 36 at each end thereof, and means, such as packings 37, 38, for rotatably receiving the ball-shaped heads in each of the piston 31 and screening member 14. Preferably the means 38 are rigidly affixed to the top bar 24.

A fluid conduit 40 is operatively connected to the top of the piston 31 and to a mechanism for selectively supplying fluid to the cylinder 32. Such a mechanism preferably takes the form of a two-way valve 42, and the valve 42 is selectively operated —such as by timer 43 as illustrated in FIG. 2 (or manually, etcetera) —to connect either a source of fluid under pressure or a vent to the top of piston 31. Preferably the source of fluid under pressure would be a conventional high pressure liquid pump 44 usually provided in digesting assemblies, while the vent would be a flash tank 45 or the like. Digester pressure is always supplied to the bottom of the piston 31.

The modification illustrated in FIG. 3 at 10' is similar to the modification of FIG. 1, and like components are indicated by like reference numerals only followed by a "'". However in this embodiment the construction of the false wall 16' is somewhat different, as is the frame for the screening structure 14'. The structure for guiding reciprocation in this embodiment comprises an elongated vertical plate 50, relatively longer than the plate 18 in the FIG. 1 embodiment, having an edge which directly engages the vertically extending edges of a plurality of curved horizontal bars 51 affixed to the back of the screen face 25'. A vertical bar 52 is connected to the topmost horizontal bar 51, with a pivot connection 53 being provided for a lever 54 which is connected to a piston (not shown). The piston and cylinder assembly (not shown) corresponding to the piston cylinder assembly 30 in the FIG. 1 embodiment are mounted in the compartment 55 between the false vessel walls 16' and the outer wall 12, and a removable cover 56 for an inspection port may be provided to view the interior of the compartment 55.

The embodiment of the invention illustrated generally at 10" in FIGS. 4 through 6 and 8 is a universally adaptable embodiment. In this embodiment structures corresponding to the structures in the FIG. 1 embodiment are illustrated by like reference numerals only followed by a "'". In this embodiment the header 19 is eliminated, and the entire screening member 14" is mounted closer to the vessel wall 12. The withdrawal conduit 21' merely penetrates the wall 12 directly into the volume V, with straight horizontal passage from the volume V into the conduit 21".

The guiding means for the FIGS. 4 through 6 and 8 embodiment include a central vertical bar 18" and a pair of end vertical bars 60, 61. The guide plates 17" for receiving the central bar 18' are segmented, as is clear from FIG. 4, and attached to a central rib 63. The central bar 18" is welded directly to the wall 12.

In the FIGS. 4 through 6 and 8 embodiment also, a pair of side vertically extending rails 64, 65 (see FIG. 6) are connected to the wall 12 adjacent the end vertical bars 60, 61 of the screening member, and provide additional vertical guidance.

Sealing of the volume V, and a stop for the downward extent of movement of the screen member 14", is provided by the lower curved horizontal bar 66 attached to the vessel wall 12. Sealing of the upper portion of the structure 10" so that liquid must pass through the screen face 25" or clearance gaps 15" to get to the volume V is provided by the hollow component 70 having plate-like body 71 spaced from the vessel wall 12 at a first end 72 thereof, and overlapping the screening member 14"(see FIGS. 4 and 5) and tapering to the vessel wall 12 at the second end 73 thereof.

Figure 6:
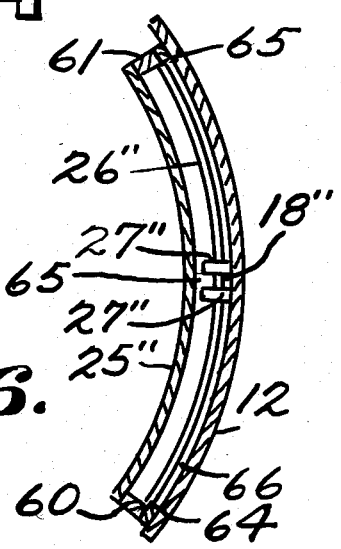
Figure 7:
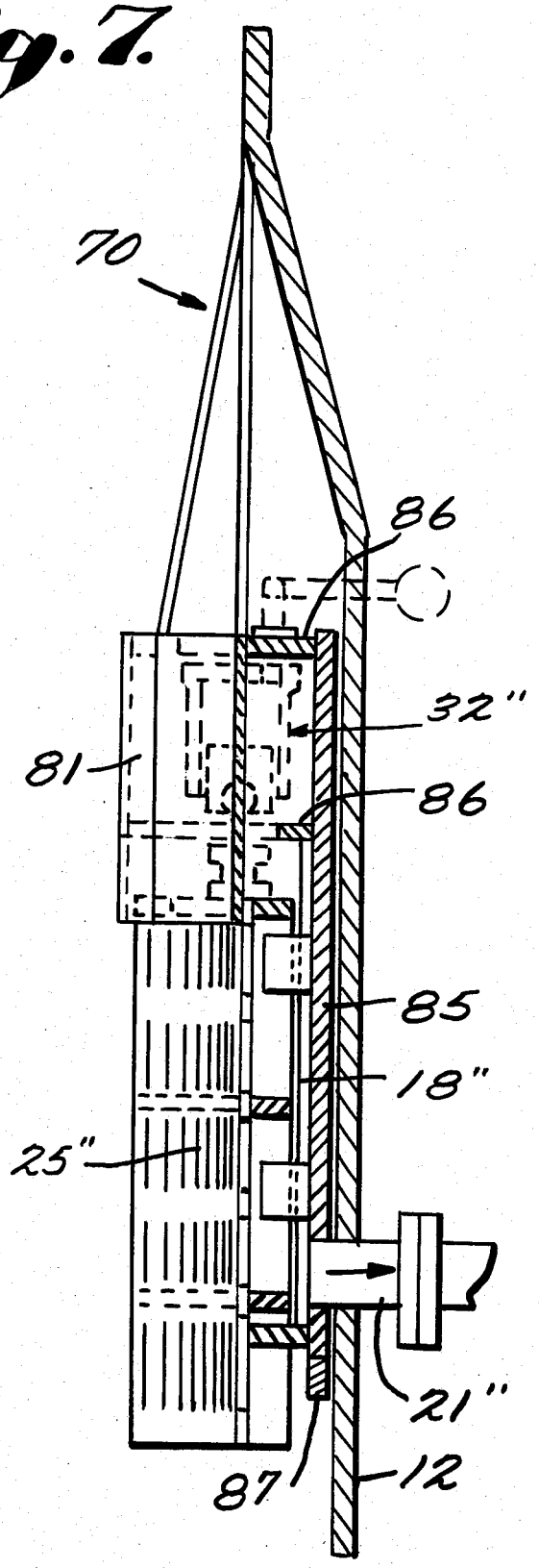
FIG. 7 is a view like that of FIG. 4 only showing the entire screen assembly as an insert.

The embodiment illustrated in FIG. 7 is substantially identical to the embodiment illustrated in FIG. 6 except that the entire screen assembly is provied as an integral insert. A common plate 85 mounts all of the mounting components 18", 64, 65, as well as the supports 86 for the cylinder 32". The entire structure mounted by plate 85 is inserted in the digester, with no modification of the digester wall 12 necessary (except the possible addition of horizontally extending curved rib 87), and the plate 85 is welded or otherwise attached to the wall 12 (and preferably the rib 87 too).

Exemplary operation of the apparatus according to the invention will now be specifically described with respect to the FIGS. 4 through 7 embodiment.

Fibrous material suspended in liquid, such as paper pulp, is introduced into the top of the vessel 11, passing downwardly therein past the screening member 14". With the cylinder 32" of the assembly 30" thereof connected to the vent 45, the pressure inside the vessel will act on the bottom of piston 31" and cause the screening member 14" to move upwardly. Once an upper limit of travel is reached, which may be approximated by the passage of a particular time, the cylinder 32" is connected to high pressure liquid source 44, causing the piston 31" to drive the screening member 14" downwardly, effecting relative movement between the screen face 25" and the pulp, causing the screen face 25" to unclog. This is continuously repeated, with liquid passing through the screen face 25" and the clearance gaps 15" being withdrawn through the conduit 21", and the cylinder 32" alternately being connected to high pressure and vent. The screening member 14" is positively guided by the plates 27", 18', bars 65, 64, etcetera throughout. Additionally the enlarged portion 80 of the upper screen frame bar 24' received by the bulge 81 formed in the hollow component 70 lodges the cylinder 32", and is shaped so as to offer the least resistance to the chip column.

It will thus be seen that according to the present invention a simple, efficient mechanism and method for keeping screens in digesters, or the like, free from clogging has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures, methods, and assemblies.

What is claimed is:

1. In a pressurized vessel for vertically passing fibrous material suspended in liquid, the vessel having a vertical wall curved about a vertical axis, a structure comprising:

a vertically elongated screening member, curved about a vertical axis;

means for mounting said screening member inside and adjacent the vertical wall of the vessel, for up and down reciprocal movement, defining a screening volume between the screening member and the vertical wall; and for substantially sealing the screening volume from the interior of the vessel, except through the screening member and clearance gaps between the screening member and the vessel wall, during reciprocation of the screening member; and means for reciprocating said screening member vertically up and down with respect to the vertical wall, said reciprocating means comprising: a piston and cylinder assembly mounted within said screening volume; means for operatively attaching said piston to said screening member; a fluid conduit operatively connected to one side of said piston and to a two-way valve, the vessel pressure acting on the other side of said piston; and means for selectively operatively connecting said valve to a source of fluid under pressure or a vent.

2. A structure as recited in claim 1 wherein said means for operatively attaching said piston to said screening member comprises universal joint means.

3. A structure as recited in claim 2 wherein said universal joint means comprises a rod having a ball-shaped head at each end thereof, and means for rotatably receiving a said ball-shaped head in each of said piston and said screening member.

4. A structure as recited in claims 1 or 2 further comprising header means disposed inside said screening volume, and a conduit leading from said header means to the exterior of the vessel.

5. A structure as recited in claim 4 wherein said mounting means comprises vertically extending guide means disposed in the screening volume for guiding reciprocation of the screening member.

6. A structure as recited in claims 1 or 2 wherein said screening member comprises a frame comprising a solid, curved, horizontally elongated top bar, and at least one other bar substantially parallel to and spaced from the top bar; and a perforated metal screen face integral with said bars and disposed on the opposite side of said bars as the vertical vessel wall.

7. A structure as recited in claim 6 wherein said frame further comprises a vertically extending central bar; and further comprising guide means extending from the vessel vertical wall straddling said central bar for guiding it during vertical reciprocation of said screening member.

8. A structure as recited in claim 1 in combination with a high pressure liquid pump and a flash tank as said source of fluid under pressure and said vent, respectively.

9. A structure as recited in claim 1 or 8 wherein said piston and cylinder assembly consists of a single piston and cylinder assembly, and further comprising means for mounting said piston and cylinder assembly vertically above said screening member.

10. A structure as recited in claim 1 wherein a plurality of spaced screening members and reciprocating means are mounted in the vessel around the interior perimeter thereof.

11. A structure as recited in claim 1 further comprising a hollow component having a plate-like body with a curvature corresponding to the curvature of the screening member, spaced from the vessel vertical wall at a first end thereof, said first end overlapping said screening member and disposed interiorly thereof, and tapering to said vessel wall at a second end thereof, opposite said first end.

12. In a vessel for vertically passing fibrous materials suspended in liquid, the vessel having a vertical wall curved about a vertical axis, the structure comprising:

a vertically elongated screening member, curved about a vertical axis;

means for mounting said screening member inside and adjacent the vertical wall of the vessel, for up and down reciprocal movement, defining a screening volume between the screening member and the vertical wall so that liquid from the interior of the vessel must pass through the screening member of associated clearance gaps to enter the screening volume; and means for reciprocating said screening member vertically up and down with respect to the vertical wall, said reciprocating means comprising a piston and cylinder assembly, and universal joint means for operatively attaching the piston to said screen member, said universal joint means comprising a rod having a ball-shaped head at each end thereof, and means for rotatably receiving a said ball-shaped head in each of said piston and said screening member.

13. A structure as recited in claim 12 wherein said piston and cylinder assembly consists of a single piston and cylinder mounted vertically above said screening member.

14. A structure as recited in claim 12 or 13 further comprising a fluid conduit operatively connected to one side of said piston into a two-way valve; and means for selectively operatively connecting said valve to a source of fluid under pressure or a vent.

15. A structure as recited in claim 12 wherein said screening member comprises a frame comprising a solid, curved, horizontally elongated top bar, and at least one other bar substantially parallel to and spaced from the top bar; and a perforated metal screen face integral with said bars and disposed on the opposite side of said bars as the vertical vessel wall.

16. A structure as recited in claim 15 wherein said frame further comprises a vertically extending central rib; and further comprising guide means extending from the vessel vertical wall straddling said central rib for guiding it during vertical reciprocation of said screening member.

17. In a vessel for vertically passing fibrous materials suspended in liquid, the vessel having a vertical wall curved about a vertical axis, a structure comprising:

a vertically elongated screening member, curved about a vertical axis;

means for mounting said screening member inside and adjacent the vertical wall of the vessel for up and down movement, defining a screening volume between said screening member and the vertical wall so that liquid must pass through the screening member or associated clearance gaps from the interior of the vessel to enter the screening volume; said mounting means comprising vertically extending guide means disposed in the screening volume for guiding reciprocation of the screening member, including a vertically extending central rib attached to said screening member and received between a pair of vertically extending plates attached to the digester vertical wall; and reciprocating means mounted above said screening member within said screening volume for reciprocating said screening member vertically up and down with respect to the vertical wall.

18. A structure as recited in claim 17 wherein said screening member comprises a frame comprising a solid, curved, horizontally elongated top bar, and at least one other bar substantially parallel to and spaced from the top bar; and a perforated metal screen face integral with said bars and disposed on the opposite side of said bars as the vertical vessel wall, said central rib also forming a part of said frame.

19. A structure as recited in claims 17 or 18 further comprising a hollow component having a plate-like body with a curvature corresponding to the curvature of the screening member, spaced from the vessel vertical wall at a first end thereof, said first end overlapping said screening member and disposed interiorly thereof, and tapering to said vessel wall at a second end thereof, opposite said first end.

20. A strucutre as recited in claim 17 wherein said means for mounting said screening member comprises an integral insert structure, and means for attaching said insert to the vessel wall.

* * * * *